US006722934B2

(12) United States Patent
Roos

(10) Patent No.: US 6,722,934 B2
(45) Date of Patent: Apr. 20, 2004

(54) MARINE JET DRIVE WITH THROUGH-THE-NOZZLE EXHAUSTING

(75) Inventor: Paul W. Roos, Delray Beach, FL (US)

(73) Assignee: American Hydro Jet Corporation, Racine, WI (US)

( * ) Notice: Subject to any disclaimer, the term of this patent is extended or adjusted under 35 U.S.C. 154(b) by 0 days.

(21) Appl. No.: 10/098,708

(22) Filed: Mar. 15, 2002

(65) Prior Publication Data

US 2002/0090867 A1 Jul. 11, 2002

Related U.S. Application Data

(60) Continuation-in-part of application No. 09/540,135, filed on Mar. 31, 2000, now Pat. No. 6,358,107, which is a continuation of application No. 09/028,735, filed on Feb. 24, 1998, now Pat. No. 6,045,418, which is a division of application No. 08/456,188, filed on May 31, 1995, now Pat. No. 5,720,635, which is a division of application No. 07/699,336, filed on May 13, 1991, now Pat. No. 5,421,753.

(51) Int. Cl.[7] ..... B63H 21/32

(52) U.S. Cl. ..... 440/89 A; 440/89 R; 440/38

(58) Field of Search ..... 440/38, 47, 89, 440/89 R, 89 A

(56) References Cited

U.S. PATENT DOCUMENTS

| | | | | | |
|---|---|---|---|---|---|
| 3,249,083 | A | * | 5/1966 | Irgens | 440/89 |
| 3,369,518 | A | * | 2/1968 | Jacobson | 440/38 |
| 3,943,876 | A | * | 3/1976 | Kiekhaefer | 440/89 |
| 4,631,032 | A | * | 12/1986 | Nishida | 440/83 |
| 4,643,685 | A | * | 2/1987 | Nishida | 440/42 |
| 4,872,858 | A | * | 10/1989 | Hasegawa et al. | 440/38 |

* cited by examiner

*Primary Examiner*—Ed Swinehart
(74) *Attorney, Agent, or Firm*—Jansson, Shupe & Munger, Ltd

(57) ABSTRACT

A marine jet drive having through-the-nozzle engine exhaust, thereby to avoid or minimize noxious odors, noise and heat problems. A method for improving marine jet drive engine performance, including producing suction to facilitate exhaust flow from the engine by discharging exhaust within the water outflow in the nozzle; exhaust is most preferably discharged at a position flush with the position of water discharge.

4 Claims, 4 Drawing Sheets

MARINE JET DRIVE WITH THROUGH-THE-NOZZLE EXHAUSTING

RELATED APPLICATIONS

This is a continuation-in-part of Ser. No. 09/540,135, filed Mar. 31, 2000, and to be hereafter issued as U.S. Pat. No. 6,358,107, which in turn is a continuation of Ser. No. 09/028,735, filed Feb. 24, 1998, now U.S. Pat. No. 6,045,418, which in turn is a divisional of Ser. No. 08/456,188, filed May 31, 1995, now U.S. Pat. No. 5,720,635, which in turn is a divisional of Ser. No. 07/699,336, filed May 13, 1991, now U.S. Pat. No. 5,421,753.

FIELD OF THE INVENTION

This invention is related generally to propulsion units for boats and, more particularly, to marine jet drives.

BACKGROUND OF THE INVENTION

Marine jet drives which propel vessels by means of water jets have long been known and used, and have certain significant advantages over the traditional external propeller units. A typical marine jet drive includes an engine-driven impeller which rotates inside an impeller housing. The impeller pumps water from below the vessel through a water intake duct, and then pressurizes and expels the water through a diffusor housing and a nozzle behind the vessel.

A typical example of such a conventional marine jet drive is seen in U.S. Pat. No. 3,935,833, which shows a pump which may be driven vertically or horizontally and is positioned near the bottom and transom of a marine vessel. The conventional jet propulsion systems have certain general advantages that make them especially attractive under circumstances where a conventional ship's propeller would be exposed to damage by contact with underwater objects. A jet drive has the further advantages that it does not produce appendage drag allowing more efficient operation and that it is safe for swimmers and animals that could be hurt by the rotating blades of an external propeller.

Despite these advantages, marine jet drives of the prior art have some problems and shortcomings, including as set forth below:

Among the problems with marine jet drives, as often with vessels having conventional propulsion means, are that the exhaust produces significant noxious odor, noise and heat signature behind and near the vessel, adversely affecting personnel on and near the vessel. In certain vessels with conventional propulsion means, exhaust can be released under water, which in theory can mitigate the problems to some extent. This in some cases can also be done with vessels having marine jet drives; however, as with conventional vessels, significant problems can remain.

Indeed, in marine jet drives, underwater exhausting is particularly problematic, because any exhaust gases in the water which is pumped into the jet drive unit from beneath the vessel will drastically interfere with operation of the jet drive—a very serious problem. Thus, the problems of noxious odors, noise and heat behind and near the vessel are particularly difficult to solve in vessels having marine jet drives.

In the past there have been some efforts to in some manner use the jet stream in connection with exhaust. One example is U.S. Pat. No. 3,943,876, which shows engine exhaust in combination with the jet stream; however, the exhaust is peripheral to the jet stream and is added behind the jet nozzle. The system of such patent does not significantly enhance efficiency or remove exhaust fumes and heat with the jet stream, nor does it serve to adequately suppress exhaust noise. U.S. Pat. No. 4,552,537 uses exhaust gases and engine-generated heat to decrease behind-the-jet nozzle frictional losses between a submerged jet stream and surrounding water in order to render the jet stream more effective.

In prior art marine jet drives, however, exhaust gases are not discharged with the jet stream. However, even if such an idea had been considered, difficult and highly significant problems would arise relating to a seeming inability to discharge the engine exhaust gas with the jet stream. The problem would be the matter of just how one would reasonably get the exhaust into the jet stream at the appropriate location.

In summary, substantial problems and shortcomings exist with respect to dealing with the engine exhaust of marine jet drives.

OBJECT OF THE INVENTION

It is accordingly a primary object of the present invention to provide a marine jet drive propulsion system that overcomes problems and shortcomings of the prior art, including those set forth above.

Another object of this invention is to provide a marine jet drive propulsion system that overcomes disadvantages of the known jet drives.

Another object of this invention is to provide a marine jet drive which increases the comfort of people in the vessel by overcoming the problems of noxious odors, noise and heat behind and near the vessel.

Another object of this invention is to provide a marine jet drive which is quite and powerful in operation.

Another object of this invention is to provide a marine jet drive which avoids any release exhaust near the vessel.

Still another object of the invention is to provide a marine jet drive which successfully merges the engine exhaust stream into the jet stream of the jet drive at an appropriate location.

Yet another object of this invention is to provide a marine jet drive with improved engine performance.

These and other objects of the invention will be apparent from the following descriptions and from the drawings.

SUMMARY OF THE INVENTION

This invention is an improved marine jet drive which overcomes various problems and shortcomings of the prior art, including those referred to above. The invention is a marine jet drive system which places the engine exhaust internal to the jet stream of water. This serves to improve engine efficiency because of suction created by the jet stream, and greatly improves the comfort of people on the vessel by releasing the exhaust and its attendant noxious odors, noise and heat to the atmosphere well behind the vessel. The invention also involves particular structures which serve to allow engine exhaust to exit through the jet drive water stream.

Marine jet drives are, of course, powered by engines having exhaust lines. Each marine jet drive has an impeller and an impeller housing, a diffusor having a diffusor housing and stator vanes, a nozzle having a rearward end, and a water intake duct in front of the impeller housing. The improvement of this invention involves an inner housing which (a) is disposed inside the diffusor housing, (b) forms an inner exhaust chamber, (c) has an exhaust discharge tube portion that extends rearwardly into the nozzle and terminates in a rearward opening, and (d) is attached to the diffusor housing by the stator vanes. The exhaust line extends to the diffusor housing, and at least one of the stator vanes is hollow and open at its opposite ends to allow exhaust to flow from the exhaust line to the inner exhaust chamber, such that the exhaust exits through the exhaust discharge tube portion into the jet water flow.

Preferred embodiments include a plenum on the outside of the diffusor housing, such plenum feeding exhaust to a plurality of hollow stator vanes.

The preferred embodiments also preferably include a valve on the plenum which serves to vent the plenum when pressure in the plenum is greater than ambient pressure. Such valve remains closed when pressure in the plenum is not greater than ambient pressure. Operation of this valve allows continued outflow of exhaust during other than forward jet drive operation.

It is highly preferred that the exhaust discharge tube portion be removably attached to the remainder of the inner housing. This allows easy replacement.

More broadly defined, this invention involves an exhaust discharge outlet disposed inside a marine jet drive nozzle, the discharge outlet being in fluid communication with the engine exhaust line. The fluid communication preferably is through at least one of the stator vanes which are part of the diffusor.

This invention is also a method for improving performance of an engine which drives a marine jet drive, the jet drive including, of course, a nozzle for water outflow. The inventive method involves producing suction to facilitate exhaust flow from the engine by discharging exhaust within the water outflow at the nozzle. The enhanced exhaust outflow serves to improve engine performance.

In the method of this invention, exhaust discharge is preferably from an exhaust discharge tube which is surrounded by water outflow from the jet drive nozzle. The exhaust discharge most preferably occurs at a position substantially flush with the position of water discharge, in order to obtain a maximum suction effect. The exhaust discharge tube and the jet drive nozzle preferably have discharge ends which are substantially flush with one another.

DETAILED DESCRIPTION OF PREFERRED EMBODIMENTS

Figure 1:
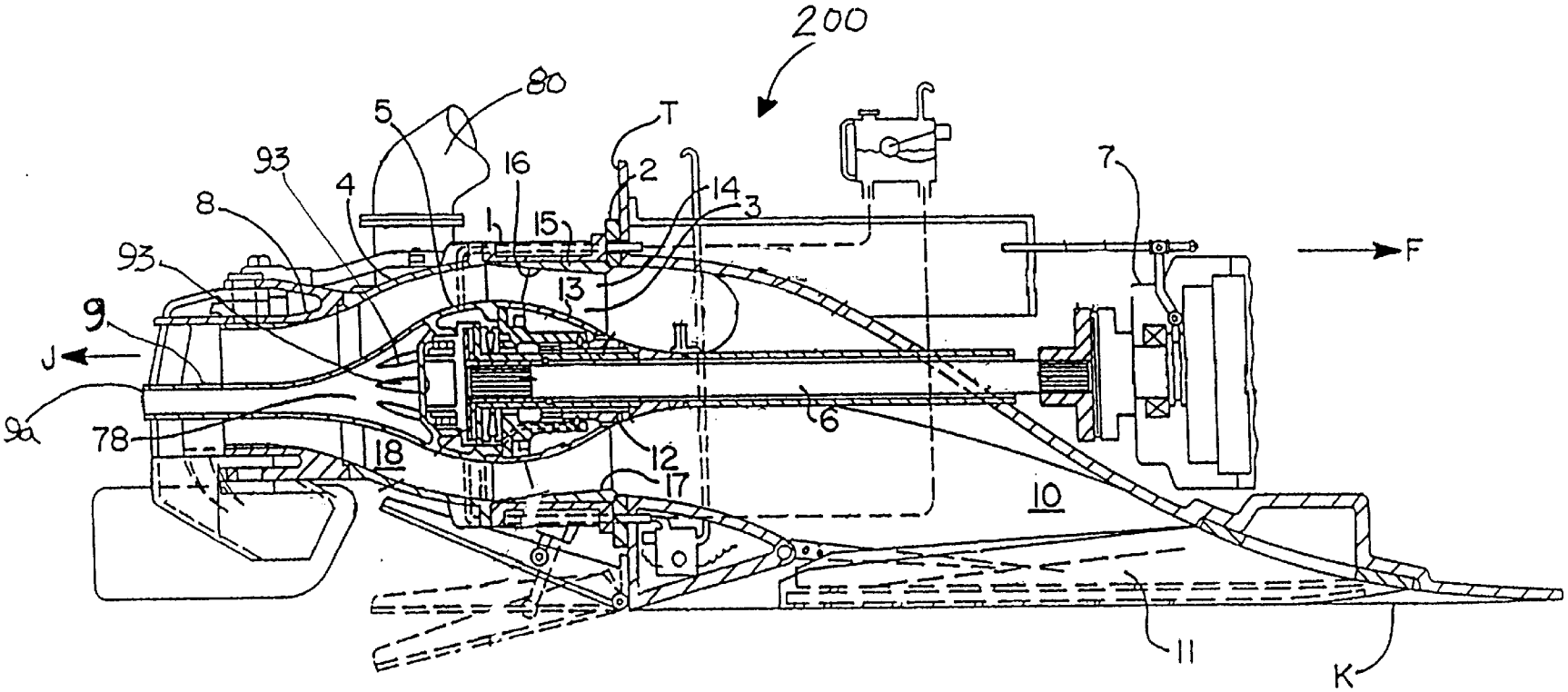
FIG. 1 is a cross-sectional view, taken along the drive-train centerline, of a marine jet drive in accordance with a preferred embodiment of this invention, showing its interior construction.
Figure 2:
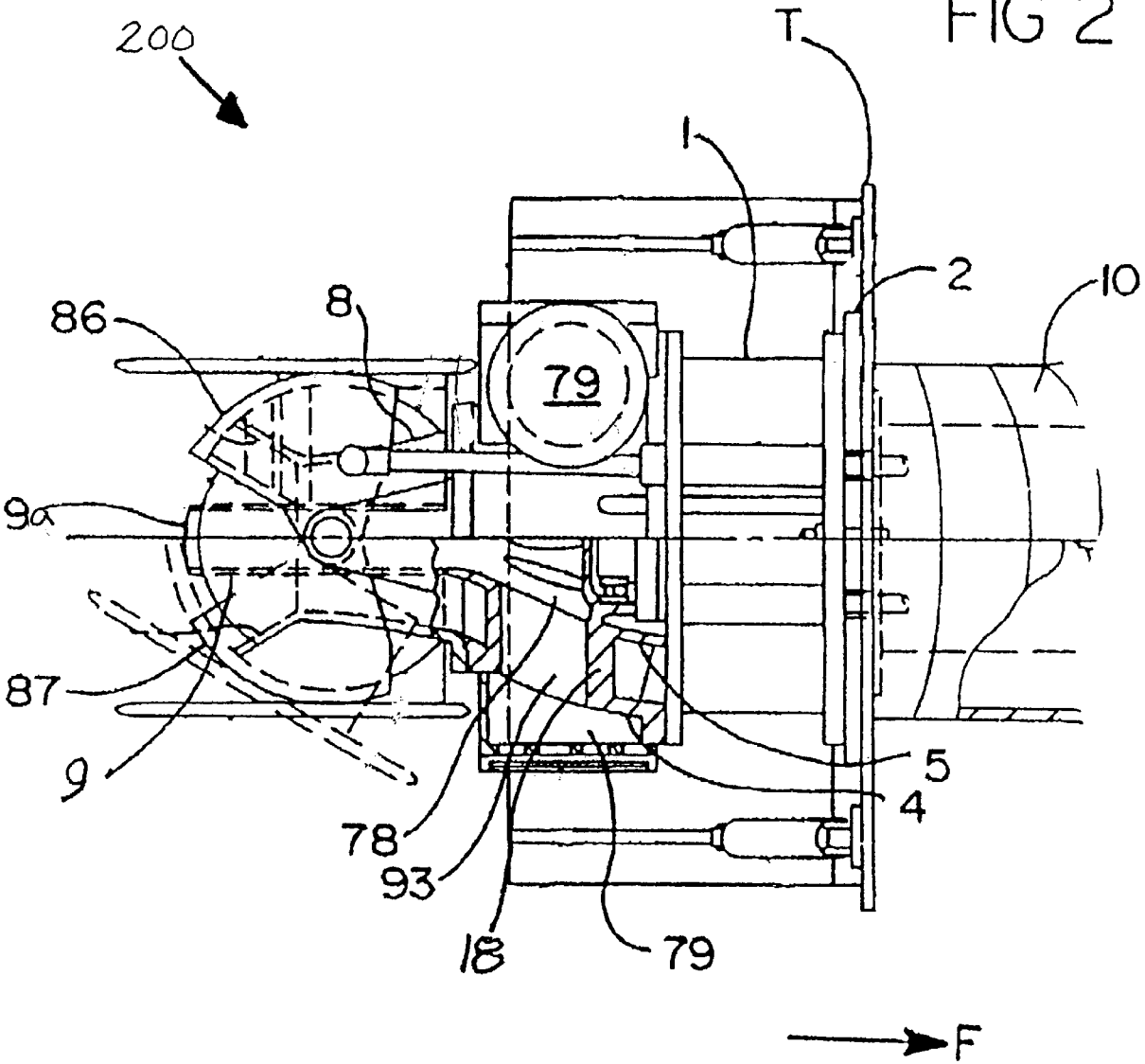
FIG. 2 is an enlarged fragmentary and partially broken top view of the jet drive shown in FIG. 1.

The figures illustrate a marine jet drive 200 in accordance with the instant invention. As shown in FIGS. 1 and 2, jet drive 200 is located generally at the transom T of a vessel and generally above the keel line K. The direction of the jet stream J is rearward, causing the vessel to move forward as indicated by arrow F.

Jet drive 200 has the following components: an impeller housing 1 attached to intake flange 2; a rotatable impeller 3 disposed in impeller housing 1 and having an axis of rotation aligned generally with keel line K; a diffusor housing 4; an inner housing 5 disposed inside diffusor housing 4; a drive shaft 6 rotatably connecting impeller 3 with an engine 7 (shown in very fragmentary form); a rearward-facing nozzle 8 attached to diffusor housing 5 and having means of deflecting jet stream J; an engine exhaust discharge tube 9 which forms a portion of inner housing 5; a water intake duct 10 which is placed ahead of impeller housing 1, attached to the vessel to transmit the generated thrust forces thereto; and an intake grid 11 disposed in water intake duct 10.

Impeller 3 includes an impeller hub 12, an impeller bell 13 and a plurality of impeller blades 14 having blade tips 16 radially extending from impeller bell 13. A circular wear ring insert 15 is inserted coaxially, snugly fitting the inside of impeller housing 1. Impeller blade tips 16 extend to within close proximity of the inner surface 17 of wear ring insert 15. Blades 14 are advantageously positioned to promote fluid flow from water intake duct 10 to diffusor housing 4 when impeller 3 rotates.

Diffusor housing 4 supports inner housing 5 by a plurality of stator vanes 18, which are radially disposed between diffusor housing 4 and inner housing 5, as seen best in FIG. 1. Stator vanes 18 are advantageously positioned to recover the rotational energy imparted by impeller 3. Several of stator vanes 18 are hollow to form internal ducts (or ports) 93 for transmitting exhaust gases to inner housing 5 from the periphery of diffusor housing 4, as described further below.

Exhaust discharge tube portion 9 of inner housing 5 is the rear portion of inner housing 5 and has a rearward end 9*a* that is located in the jet stream within nozzle 8, thereby producing suction for the discharge of engine exhaust gases. Exhaust discharge tube 9 is supported in place by being a portion of inner housing 5; as a part of inner housing 5, it is in fluid communication with an inner exhaust chamber 78.

A pair of outer plenums 79 are located on the periphery of diffusor housing 4 and are in fluid communication with inner exhaust chamber 78 via ducts 93 extending through several of stator vanes 18. The exhaust from a pair of engine exhaust lines 80 (see FIGS. 1 and 3) enters outer plenums 79, and from there flows through ducts 93 into inner exhaust chamber 78.

Outer plenums 79 are provided with flapper valves 81 that open when pressure inside outer plenums 79 exceeds atmospheric pressure. This allows engine exhaust gases to escape when impeller 3 is not turning or when jet drive 200 is operating in reverse. When jet drive 200 is operating in reverse mode, exhaust discharge tube 9 is substantially closed by steering/reversing deflectors 86 and 87, thereby preventing water from entering the exhaust system.

The exhaust suction created at rearward end 9*a* of exhaust discharge tube 9 has a beneficial effect on the performance of engine 7, thereby improving efficiency and increasing available power. Exhaust fumes are ejected with water jet stream J, and exhaust noise is muffled since it is not exposed to the atmosphere in the vicinity of the vessel. Exhaust discharge occurs at a position surrounded by water outflow from the jet drive nozzle 8.

Exhaust discharge tube 9 may be detachable from the remainder of inner housing 5 for ease of replacement of tube 9. This avoids the need for a complicated and costly maintenance (or nozzle selection) procedure.

Figure 3:
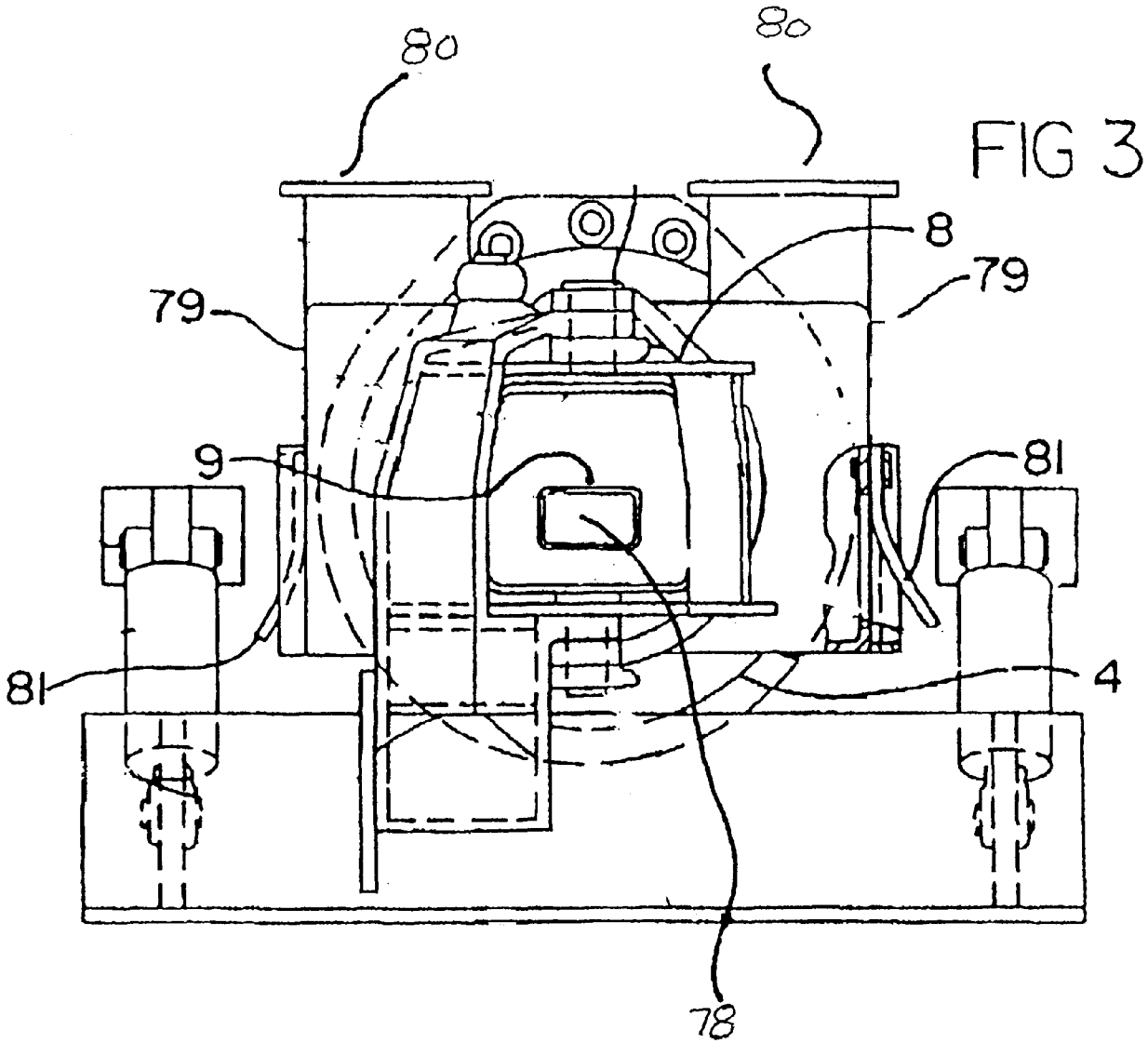
FIG. 3 is an enlarged left-side elevation of FIG. 1, i.e., a rear elevation of the jet drive.
Figure 4:
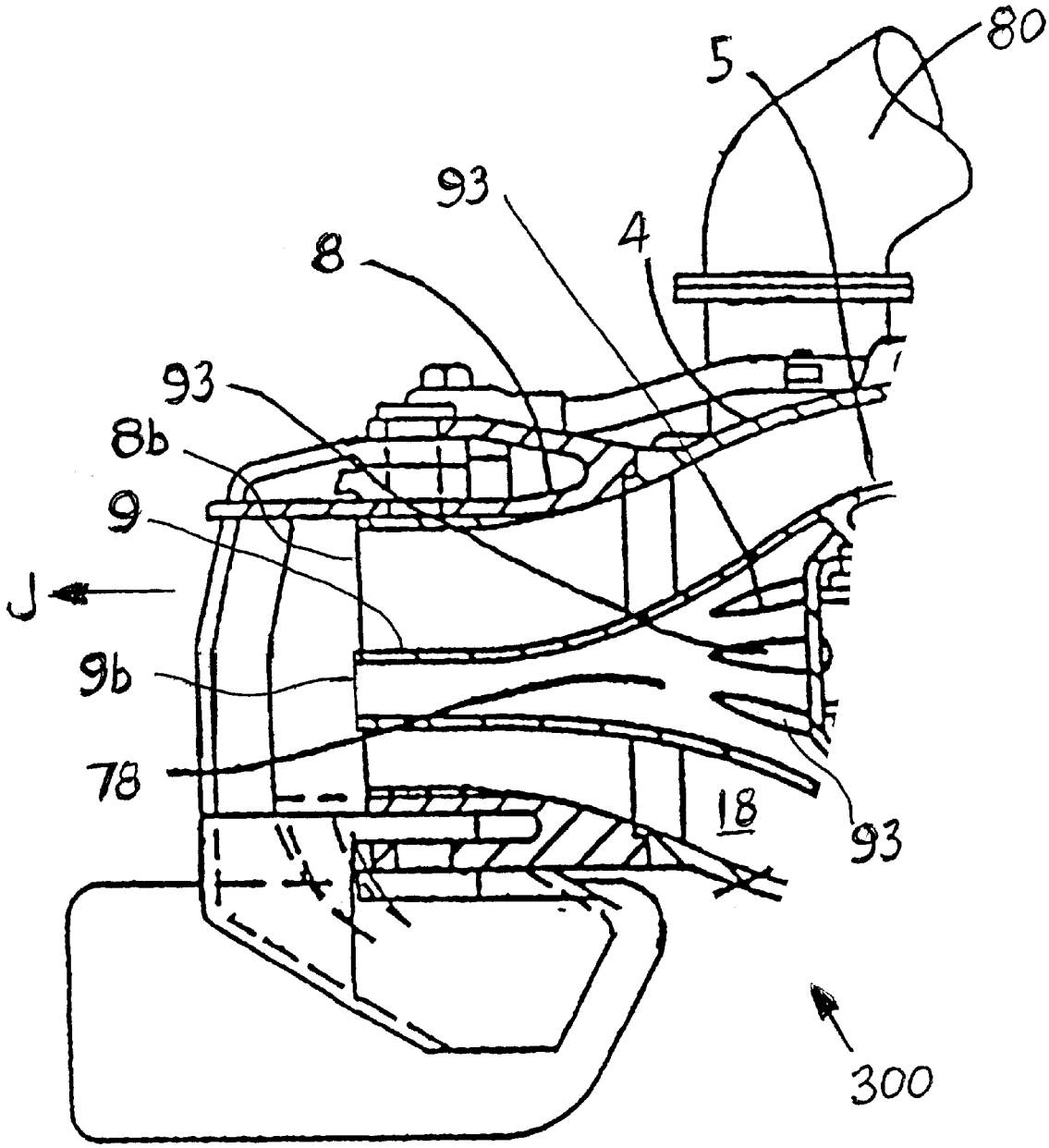
FIG. 4 is an enlarged fragmentary cross-sectional view of an alternative embodiment, taken along the drive-train centerline (as in FIG. 1), illustrating a preferred variation.

FIG. 4 shows a portion of a marine jet drive 300 which is a preferred variation of marine jet drive 200 of FIGS. 1–3.

Jet drives 200 and 300 differ only in the locations of the discharge ends of their exhaust discharge tubes 9 at their respective jet drive nozzles 8. Except for the numbering for the rearward end 9*b* of exhaust discharge tube 9 of marine jet drive 300, the part numbers used for marine jet drive 300 of FIG. 4 are identical to the numbers for the corresponding identical parts of marine jet drive 200 of FIGS. 1–3.

It is highly preferred that the exhaust discharge occur at a position which is substantially flush with the position of water discharge, in order to obtain a maximum suction effect. Thus, as shown in FIG. 4, rearward end (i.e., discharge end) 9*b* of exhaust discharge tube 9 and the discharge end 8*b* of nozzle 8 are substantially flush with one another.

While the principles of this invention have been described in connection with specific embodiments, it should be understood clearly that these descriptions are made only by way of example and are not intended to limit the scope of the invention.

What is claimed is:

1. In a marine jet drive in a vessel, the jet drive fixedly mounted in the vessel above the keel at the transom of the vessel and protruding therethrough, and powered by an inboard engine having an exhaust line, the jet drive having an impeller and an impeller housing, a diffusor having a diffusor housing and stator vanes, a nozzle which has a rearward discharge end and is positioned to discharge water from the transom, and a water intake duct at the bottom of the vessel in front of the impeller housing, the improvement wherein:

an inner housing (a) is disposed inside the diffusor housing, (b) forms an inner exhaust chamber, (c) has an exhaust discharge tube portion extending rearwardly into the nozzle and terminating in a rearward opening, and (d) is attached to the diffusor housing by the stator vanes;

the exhaust line extends from the inboard engine to the diffusor housing; and at least one of the stator vanes is hollow and open at its opposite ends for exhaust flow from the exhaust line to the inner exhaust chamber, so that exhaust exits through the exhaust discharge tube portion at the nozzle into the jet water flow thereby to facilitate removal of exhaust and increase efficiency of operation in a waterjet which is fixedly installed in a vessel and driven by an inboard engine.

2. The marine jet drive of claim 1 further comprising a plenum on the outside of the diffusor housing and a plurality of the hollow stator vanes.

3. The marine jet drive of claim 2 further comprising a valve on the plenum, the valve configured to vent the plenum when pressure in the plenum is greater than ambient pressure and to close when pressure in the plenum is not greater than ambient pressure, thereby allowing continued outflow of exhaust during other than forward jet drive operation.

4. In a marine jet drive in a vessel, the jet drive fixedly mounted in the vessel above the keel at the transom of the vessel and protruding therethrough, and powered by an inboard engine having an exhaust line, the jet drive having an impeller and an impeller housing, a diffusor having stator vanes, a nozzle which has a rearward discharge end and is positioned to discharge water from the transom, and a water intake duct at the bottom of the vessel in front of the impeller housing, the improvement comprising an exhaust discharge outlet disposed inside the nozzle, the discharge outlet being in fluid communication with the exhaust line extending from the inboard engine, such fluid communication being through at least one of the stator vanes.

* * * * *